United States Patent [19]

Starlinger-Huemer

[11] Patent Number: 4,846,229

[45] Date of Patent: Jul. 11, 1989

[54] CIRCULAR LOOM

[76] Inventor: Franz X. Starlinger-Huemer, Sonnenuhrgasse 4, 1060 Vienna, Austria

[21] Appl. No.: 119,139

[22] Filed: Nov. 10, 1987

[30] Foreign Application Priority Data

Nov. 11, 1986 [CH] Switzerland ..... 04503/86

[51] Int. Cl.[4] ..... D03D 37/00

[52] U.S. Cl. ..... 139/13 R; 139/50

[58] Field of Search ..... 139/13 R, 50, 53, 54

[56] References Cited

U.S. PATENT DOCUMENTS

| | | | |
|---|---|---|---|
| 1,139,073 | 5/1915 | Rhomoser | 139/13 R |
| 3,220,440 | 11/1965 | Malchair | 139/54 |
| 3,242,949 | 3/1966 | Taticek | 139/54 |
| 3,376,899 | 4/1968 | Tubau-Quintana | 139/54 |
| 3,463,199 | 8/1969 | Crenshaw et al. | 139/54 |
| 4,719,946 | 1/1988 | Buchinger et al. | 139/13 R |

*Primary Examiner*—Henry S. Jaudon

[57] ABSTRACT

In a circular loom, displacement means engage on the inner partial heald (7) of a partial heald pair (6, 7) after each shedding motion in order to bring about the instantaneous lateral relative counter-displacement of the partial healds for the reciprocal displacement of the leno thread (51), extending lengthwise to the ground thread (50), two neighboring warp threads (50, 51), for the production of a leno fabric (6, 7). Furthermore, the warp threads of one partial heald of a partial heald pair are guided freely by thread guide means (24) to bring about the shedding, and, on the other partial heald, to bring about a side change.

10 Claims, 3 Drawing Sheets

Fig. 3
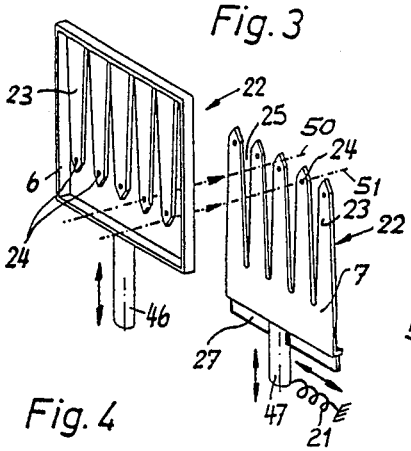
Fig. 8
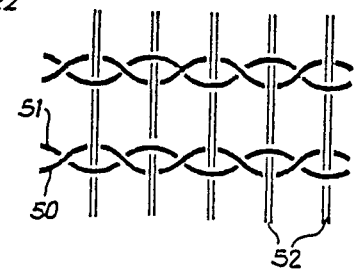
Fig. 4
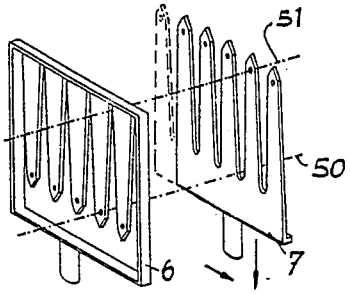
Fig. 5
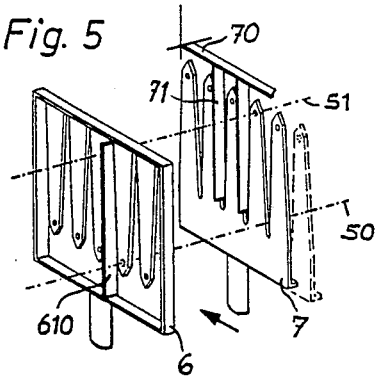
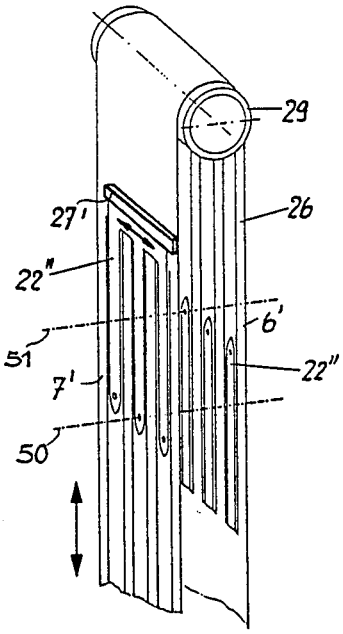
Fig. 7

CIRCULAR LOOM

FIELD OF THE INVENTION

The present invention relates to a circular loom comprising inner and outer partial healds arranged circularly in two rows around a main shaft of the loom. The partial healds are arranged in pairs for the guidance of a part of the two annularly distributed warp yarn groups, which, for the formation of the weaving or travelling shed, are given an oppositely phased up-and-down reciprocating motion by way of the loom main shaft.

BACKGROUND OF THE INVENTION

Of the fabrics woven on looms, the so-called leno fabric is of particular importance. In such fabric two neighboring warp threads no longer lie parallel next to each other, but the so-called leno thread loops or crosses the other warp thread, here referred to as the ground thread, in such a way that the weft threads are bound in unable to slip.

Hence, it has long been the wish to be able to produce such leno fabrics also on circular looms, in particular for the manufacture of tubular fabrics made from narrow plastic strands for the fabrication of sacks, which hitherto could not be satisfactorily accomplished.

OBJECT OF THE INVENTION

The object of the invention is to arrange and guide the oppositely-phased up-and-down-moving partial healds in such a way that after each shed-forming alternating motion, the two interacting weft threads permit a reciprocal displacement of each other.

SUMMARY OF THE INVENTION

The task is solved according to the invention thereby that displacement means engage at least one partial heald of a partial heald pair after each shedding motion in order to bring about instantaneous lateral relative counter-displacement of the partial healds for the reciprocal displacement of the leno thread, extending lengthwise to the ground thread, for the production of a leno fabric; and that the warp threads of one partial heald of a partial heald pair are guided freely by thread guide means to bring about the shedding, and, on the other partial heald, to bring about a side change.

With this it is possible each time after a weft passage, to produce a preliminary tension on said warp threads by the displacement of said partial healds relative to one another in the one or the other direction, which, at the zero-passage of the partial healds by the reciprocal motion thereof, causes said warp threads to jump each time onto the other side of the other warp thread, which consequently results in a leno fabric.

To ensure this mechanically, it is of advantage when the partial healds support comb-like guide means for said warp threads, the teeth or prongs of said guide means each having a thread eye disposed on the free end thereof for the shedding guidance of a warp thread, and, defining between each tooth and the next, thread guide slits for the freely guided warp threads for bringing about the side change. It is necessary that the partial healds of the partial heald pair support comb-like guide means arranged opposite to each other.

In order to prevent an overjumping of the alternating warp threads, it is of advantage when rigidly mounted separating tongues extend in the gaps of the comb-like guide means.

In this connection, the comb-like guide means may be mounted on guide rods as well as also being disposed at interstices on the slit inner strand or outer strand of a belt strand, thus forming a partial heald pair.

It is then of advantage if the lateral relative counter-displacement of said partial healds is effected by way of the displacement of said comb-like guide means of said inner partial healds.

Here, the lateral displacement of said comb-like guide means can result along a horizontal guide or by a rocker bearing.

Moreover, it is expedient when the displacement means for the instantaneous lateral relative counter-displacement of the comb-like guide means comprise rocking levers that can be swivelled in the lifting movement of the partial healds by the cam, revolving with the main shaft, or by ratchet means operable by the lifting movement of the partial healds.

BRIEF DESCRIPTION OF THE DRAWING

Embodiments of the present invention will now be more particularly described by way of example and with reference to the accompanying drawing, in which:

FIGS. 3, 4 and 5 show a partial heald pair of the circular loom according to FIG. 1, in a larger diagrammatic partial view in different functioning states;

FIG. 7 is a diagrammatic partial view of another embodiment of a partial heald pair;

FIG. 8 is a leno fabric producible by a circular loom according to the invention;

SPECIFIC DESCRIPTION

Figure 1:
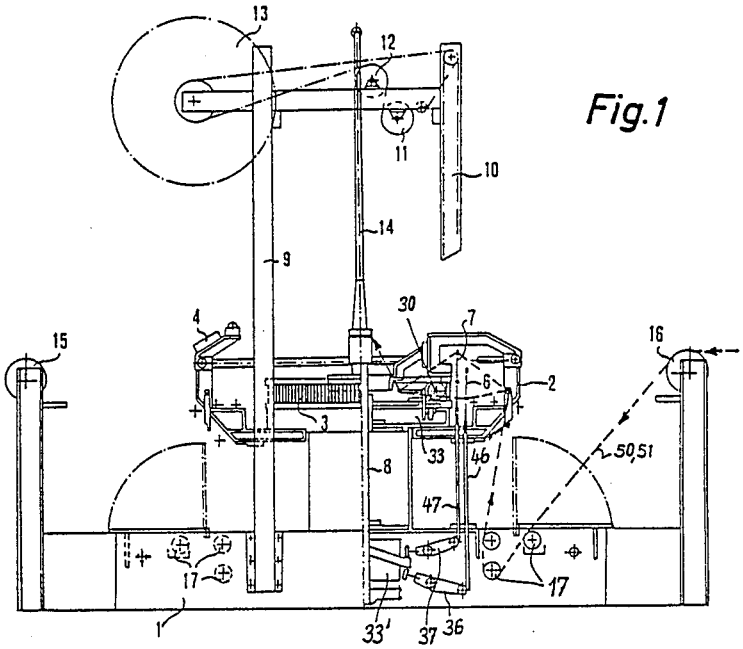
FIG. 1 is a schematic side elevation of a circular loom with the drive equipment according to the invention.
Figure 2:
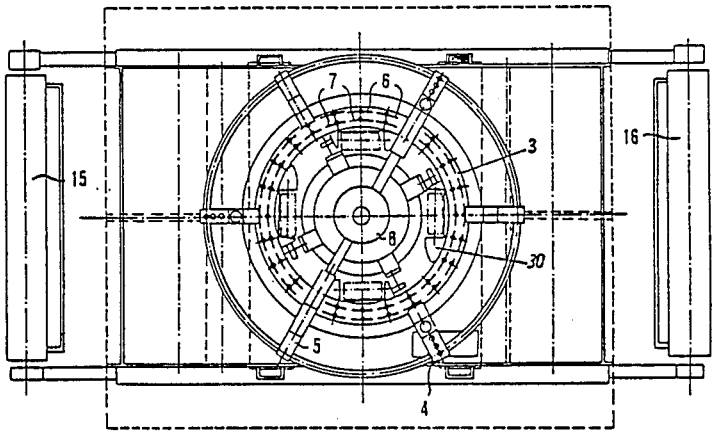
FIG. 2 is the arrangement according to FIG. 1 in a schematic plan view.

The multiphase circular loom according to FIGS. 1 and 2 rests in per se known manner on a loom base 1, which supports a circular frame carrier 2, which carries a circular reed 3, an on/off switch 4 for the loom, the frame member 5 for the ring holder and also the partial healds 6 and 7. Said partial healds 6 and 7 are arranged circularly in two rows around the main shaft 8 of the loom and form outer partial healds 6 and inner partial healds 7 (FIG. 2).

Furthermore, the support 9 for the cloth draw-off device is mounted on the loom base 1 the support comprising the drive means 10 for cloth draw-off, cloth draw-off rollers 11 and 12 and the fabric bales 13. A fabric spreader 14 is also operative in the draw-off area.

Further, on the circular loom illustrated, can be seen draw-in roller 15 for the warp threads or strands on the left (not shown in detail), and the draw-in roller 16 for the warp threads 50,51 on the right, and, in addition, the deflecting rollers 17 for said warp threads. The warp threads or strands 50,51 (FIG. 8) are divided into circularly arranged warp-thread sheets or gatherings and are drawn off from groups of thread spools (not shown in more detail) in the customary manner. For the formation of the weaving shed, one of said sheets is raised by said partial healds 6,7, while the other is brought down from the level of the weaving plane by the so-called change-of-shed motion, so that a warp top shed and a warp lower shed result. Between the sheds, at least one, as a rule several shuttles 30 with a weft-thread spool traverse on a horizontal path. Owing to the circular motion of the shuttles the weft yarn 50 (FIG. 8) that is wound off from the weft-yarn spool is transferred onto the edge of the tubular fabric being manufactured, so that said weft yarn can be woven into the fabric. The tubular fabric can then be drawn off and laid flat together.

The drive of said shuttles 30 takes place by way of a plate cam 33 on and revolving with said main shaft 8 of the loom, and which operatively engages said shuttles by means of actuating members. Further, said main shaft 8 supports here a second plate cam 33' that is operatively connected to so-called heald frame rods 46 and 47 by means of a plurality of rocking levers 36 and 37 disposed radially about said cam, said heald frame rods 46 and 47 transmit in customary manner the change-of-shed motion onto said partial healds 6 or 7.

In another embodiment of such a circular loom as previously described, said partial healds can also be made from slit belt strands, for which for approximately each partial heald, an endless belt 26 extends over each of the rotatingly supported guide rollers 29 on the upper respectively lower frame sections (FIG. 7). The inner strand and the outer strand of the belt each carry thread eyes through each of which a warp thread of one or the other warp-thread sheets is drawn. The generation of an oppositely phased up-and-down reciprocating motion of said strands of said belt, permits the previously-mentioned change-of-shed motion on the two warp-thread sheets to take place. For this change-of-shed motion, it is known that preferably said inner strand is fastened tightly below said thread eye thereof to a so-called heald slide or carriage, said slide being slid vertically up and down on guide means.

Projecting from said vertical slides are guide rollers which bear against a corresponding cam surface of the associated plate cam mounted centrally and rotatable with the main shaft of the loom.

To the extent described above, the construction of the circular loom in question here corresponds to the prior art, so that further explanation is unnecessary.

The problem to be dealt with here in connection with a circular loom as previously described, exists therein that the development of such looms is to permit the manufacture of a fabric in leno weave, as has been ellucidated above.

In order to render this possible, it is necessary each time after a web passage, to produce a preliminary tension on said warp threads 50,51 by the displacement of said partial healds 6 and 7 relatively against each other in the one or the other direction, which causes said warp threads, at the alternating motion thereof, to jump each time onto the other side of the warp thread, which consequently results in a leno fabric.

Such a leno fabric, wherein crossing leno threads 51 and the ground threads 50, two neighbouring warp threads, are bound in, unable to slip, with several weft threads 52, is shown in FIG. 8.

Consequently, it is necessary that for the reciprocal arrangement of the leno thread 51, running lengthwise to the ground thread 50, two neighbouring warp threads 50, 51, for producing a leno fabric, displacement means engage on preferably the inner partial heald 7 of a partial heald pair 6, 7 after each shedding motion to bring about the instantaneous lateral relative counter-displacement. Furthermore, the warp threads of one partial heald of said partial heald pair are in each case guided freely by thread guide means 24 (FIG. 3) to bring about the shedding and, on the other partial heald, to bring about a side change, as is subsequently illustrated in greater detail firstly by means of FIGS. 3, 4 and 5.

Accordingly, said partial healds 6, 7 support comb-like guide means 22 for said warp threads 50, 51, the teeth or prongs 23 of said guide means each having a thread eye 24 disposed on the free end thereof for the shedding guidance of a warp thread, and, defining between each tooth and the next, thread guide slits for the freely guided warp threads for bring about the side change. In this connection, the development is such that said partial healds 6 and 7 of said partial heald pair support comb-like guide means 22 arranged opposite to each other, which are here mounted on heald rods 46 and 47.

In any case, rigidly mounted separating tongues 610 extend between the thread guiding slits 25, as is indicated in FIG. 5. Said separating tongues prevent an overjumping of the alternating warp threads.

It is expedient in this connection to make said comb-like guide means 22 of the inner partial heald 7 shiftable, for which said comb-like guide means 22 is mounted on the respective heald rod 47 by, for example, a horizontal guide 27. Follower members on the respective guide means 22 can then be brought into temporary operating contact with the rotating plate cam 33 of the circular loom (FIG. 1), said follower members displacing laterally the respective guide means 22, for example, against the effect of a restoring spring, until the operating contact is disengaged again and said guide means 22 are moved back in the opposite direction by said spring (not shown).

In FIGS. 3, 4 and 5, the motion of said partial healds 6 and 7, or the comb-like guide means 22 thereof, for producing the leno fabric according to FIG. 8 can easily be recognised.

When, for example, there results an upward movement of said partial heald 7, and a downward movement of said partial heald 6 due to the so-called zero-position of said partial healds, at which position said warp threads are found in the weaving plane (FIG. 3), the leno thread 50 lies first to the left of the ground thread 51 (FIG. 4). After a change of movement, by which said partial heald 7 is in a downward position and said partial heald 6 is in an upward position, and after weft insertion has taken place, a displacement of the comb-like guide means 22 of said inner partial heald 7 takes place to the right. Thereby, said warp threads 50 and 51 receive a preliminary tensioning that causes said warp threads 50 and 51, at the next zero-passage, to change sides by jumping over, as shown in FIG. 5, which illustrates the completed change of motion. Thereby, said ground thread 50 lies to the right of said ground thread 51. At the next movement, said comb-like guide means 22 of said inner partial heald 7 can regain its other (left) extreme position under the effect of the spring 21, which again leads to a change of side of said warp threads 50 and 51, and so forth.

Figure 6:
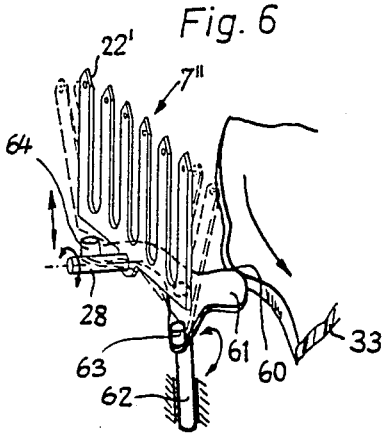
FIG. 6 is an embodiment which is a variant of the arrangement according to FIGS. 3 to 5.

The same result is achieved when the lateral displacement of the comb-like guide means 22' on the partial heald 7" takes place by way of a rocker bearing 28, as is indicated in FIG. 6. For this purpose, a swivelling rocking lever 61, having striking means 63 and 64, and being horizontal around an axle 62, extends below each inner partial heald 7'', said striking means 63 and 64 being swivelled alternately under each partial heald upon each downward movement thereof, whereupon said comb-like guide means 22 are tilted in each case from one side to the other and vice versa. Said swivelling of said rocking lever 61 takes place by way of cams 60 on the plate cam 33 of the loom.

Figure 9:
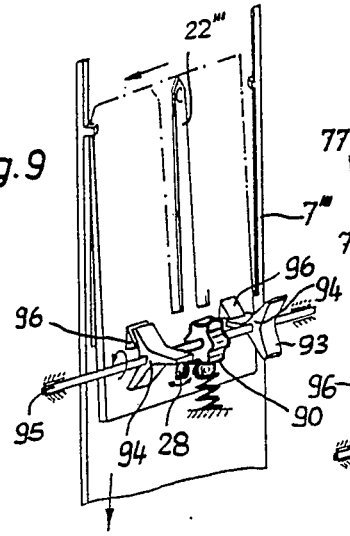
FIGS. 9 and 10 show in different functioning states, a further embodiment of a partial heald with its displacement means in different operating positions.
Figure 10:
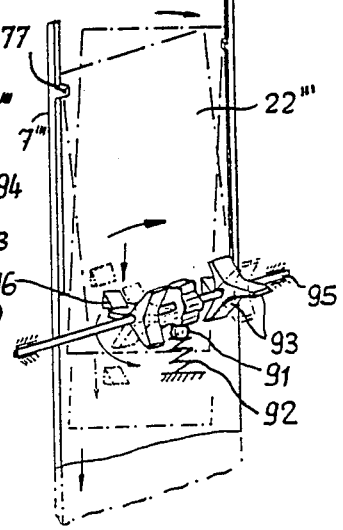
Figure 11:
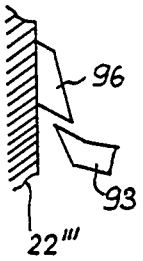
FIG. 11 is a detail view of the arrangement according to FIGS. 9 and 10, in section and on a larger scale.

A further embodiment of the arrangement according to the invention is shown in FIGS. 10 and 11, which illustrate in two different operating positions the rocking or tilting of the comb-like guide means 22''' mounted around the rocking bearing 28 in the partial heald frame 7'''. For this, a stationary-supported ratchet shaft 95, which extends horizontally near said respective partial heald 7''', is provided; said ratchet shaft, supporting regultor cam wheels 94 and having here three cams 93. Said regulator cams 93, operating together with pawls 96, projecting from said comb-like guide means 22''' in such a manner that, upon each thrust-like downward movement, said comb-like guide means 22''' is tilted to the one or the other side, with stop means 77 limiting said lifting motion. For an optimal operating connection between said cam 93 and said pawl 96 (FIG. 9 right) on the side, and, for a jumping-over (FIG. 9 left) on the other side, said cam 93 and said pawl 96 have inclined planes according to FIG. 11. Furthermore, a ratchet wheel 90 is mounted on said ratchet shaft 95, said wheel being operatively connected with a stop ball 91, which is under bearing stress by means of a prestressing spring 92. Said stop ball 91 can rock in the tooth bed of the ratchet wheel 90 in order to make a jumping-over of the one or the other cam 93 over the respective pawl 96 possible without twisting.

Moreover, circular looms by which the partial healds 6 and 7' are constructed in the previously-described manner by strap or belt strands 26, as FIG. 7 shows in detail, can, with slight alteration, be employed in the same manner. In this case, the comb-like guide means 22'' on said inner partial heald or strand 7' can, for the displacement thereof, be supported by a horizontal guide 27' (FIG. 7) or also by a rocker bearing (not shown) with displacement means according to the aforementioned embodiments as defined in FIG. 6 or FIGS. 9 and 10.

From the foregoing, there results a circular loom that henceforth also enables the efficient production of a leno fabric, with the steps taken being particularly suitable to allow existing circular looms to be changed over without great effort and expenditure.

What I claim is:

1. A circular loom for the weaving of a leno fabric, comprising:

a loom base;

a loom main shaft rotatable about an axis on said base;

an inner heald and an outer heald extending annularly around said axis, said inner and outer healds being composed of partial heald pairs of mutually juxtaposed heald members from said inner heald and said outer heald respectively, with said heald members of said inner heald being angularly spaced about said axis and said heald members of said outer heald being angularly spaced about said axis;

means for feeding warp yarns to said healds;

cam means connected to said heald members for reciprocating same parallel to said axis to impart oppositely phased shedding movement to the juxtaposed heald members of each pair to shed warp yarns fed to said healds;

means connected to said shaft for cyclically inserting a weft yarn in sheds formed by said shedding movement of said heald members, each of said heald members being formed with a comblike guide having prongs separated by spaces between said prongs, said prongs each having a thread-guiding eye at a free end of the respective prong, said warp yarns passing through a respective eye of one of the heald members of a respective pair and through a respective one of said spaces of the other heald member of the respective pair; and means operatively connected to at least one of said heald members of each pair for imparting substantially instantaneous relative lateral displacement to the heald members of each pair following a respective shedding movement to cause warp yarns in the respective spaces to jump an adjacent prong to loop around the warp yarn traversing the eye thereof.

2. The circular loom defined in claim 1 wherein the comb-like guides of the heald members of each pair are arranged opposite to one another.

3. The circular loom defined in claim 1 further comprising rigidly mounted separating tongues extending into the spaces of at least one of the heald members of each pair.

4. The circular loom defined in claim 1 wherein each of the comb-like guides is mounted on a respective heald rod.

5. The circular loom defined in claim 1 wherein the comb-like guides of the heald members of each pair are formed on opposite strands constituting the respective heald member of a common belt formed with the respective heald pair.

6. The circular loom defined in claim 5 wherein said lateral displacement is imparted to the inner heald member of each pair.

7. The circular loom defined in claim 6 wherein a horizontal guide is provided for the comb-like guide of the inner heald member of each pair.

8. The circular loom defined in claim 1 wherein said means operatively connected to at least one heald member of each pair includes a rocker bearing.

9. The circular loom defined in claim 1 wherein said means operatively connected to at least one of said heald members of each pair includes rocking levers swivelled upon the shedding mount of said healds.

10. The circular loom defined in claim 1 wherein said means operatively connected to at least one of said heald members of each pair includes ratchet means swivelled upon the shedding mount of said healds.

* * * * *